US007076932B2

(12) United States Patent
Rubin

(10) Patent No.: US 7,076,932 B2
(45) Date of Patent: Jul. 18, 2006

(54) APPARATUS AND METHOD FOR WRAPPING

(76) Inventor: Richard Howard Rubin, 2 Farmstead La., Fairfield, NJ (US) 07004

( * ) Notice: Subject to any disclaimer, the term of this patent is extended or adjusted under 35 U.S.C. 154(b) by 143 days.

(21) Appl. No.: 10/760,534

(22) Filed: Jan. 21, 2004

(65) Prior Publication Data

US 2004/0237475 A1 Dec. 2, 2004

Related U.S. Application Data

(60) Provisional application No. 60/441,115, filed on Jan. 21, 2003.

(51) Int. Cl.
*B65B 11/36* (2006.01)

(52) U.S. Cl. ..... 53/461; 53/419; 53/137.2; 53/586

(58) Field of Classification Search ..... 53/137.2, 53/148, 154, 155, 206, 209, 211, 216, 218–219, 53/228, 229, 399, 415, 419, 430, 461, 590, 53/465, 466, 586–588
See application file for complete search history.

(56) References Cited

U.S. PATENT DOCUMENTS

| | | | | |
|---|---|---|---|---|
| 4,184,306 | A * | 1/1980 | Grasson | 53/240 |
| 5,469,688 | A * | 11/1995 | Dunbar et al. | 53/419 |
| 6,023,908 | A * | 2/2000 | Vetsch | 53/155 |
| 6,023,913 | A * | 2/2000 | Gray et al. | 53/399 |
| 6,202,387 | B1 * | 3/2001 | Brown et al. | 53/419 |
| 6,609,352 | B1 * | 8/2003 | Erlund et al. | 53/254 |
| 6,615,566 | B1 * | 9/2003 | Heisey | 53/466 |
| 6,918,226 | B1 * | 7/2005 | Heilman et al. | 53/211 |

* cited by examiner

*Primary Examiner*—Stephen F. Gerrity
*Assistant Examiner*—Hemant M. Desai

(57) ABSTRACT

Embodiments of the present invention provide for a wrapping apparatus and associated methods. The wrapping apparatus may include a first holder for holding first items to be wrapped. The wrap is placed on a rotating table when the rotating table is rotated into a first position. One of the first items to be wrapped is moved from the first holder onto the wrap on the rotating table when the rotating table is rotated to a second position. A wrapping mechanism then wraps the first item in the wrap.

24 Claims, 15 Drawing Sheets

APPARATUS AND METHOD FOR WRAPPING

CROSS REFERENCE TO RELATED APPLICATION

This application claims priority from provisional application Ser. No. 60/441,115, filed on Jan. 21, 2003, which is incorporated by reference herein in it's entirety.

TECHNICAL BACKGROUND

The present invention relates to an apparatus and method for wrapping of items.

BACKGROUND OF THE INVENTION

Items that need to be wrapped in cloth, plastic or some other material are generally wrapped by hand. This process of wrapping items by hand can be very time consuming and costly. For example, restaurants often have staff wrap eating utensils in paper or cloth napkins, and sometimes use a band or other item to secure the wrapping. Such wrapping of eating utensils has been done by hand.

Other types of utensils, instruments or components may also need to be wrapped. For example, medical instruments may need to be wrapped. Wrapping of these items by hand can also be costly and time consuming.

Accordingly, what is needed is a way to automatically wrap items, that does not require wrapping of the items by hand. Further, it may be useful in some situations if such automatic wrapping could include an optional band or other item to secure the wrap, when such a securing item is desired.

SUMMARY OF THE INVENTION

Embodiments of the present invention provide for an apparatus and methods for wrapping of items. The wrapping apparatus may include a first holder for holding first items to be wrapped. The wrap is placed on a rotating table when the rotating table is rotated into a first position. One of the first items to be wrapped is moved from the first holder onto the wrap on the rotating table when the rotating table is rotated to a second position. A wrapping mechanism then wraps the first item in the wrap.

DETAILED DESCRIPTIONS

Figure 1:
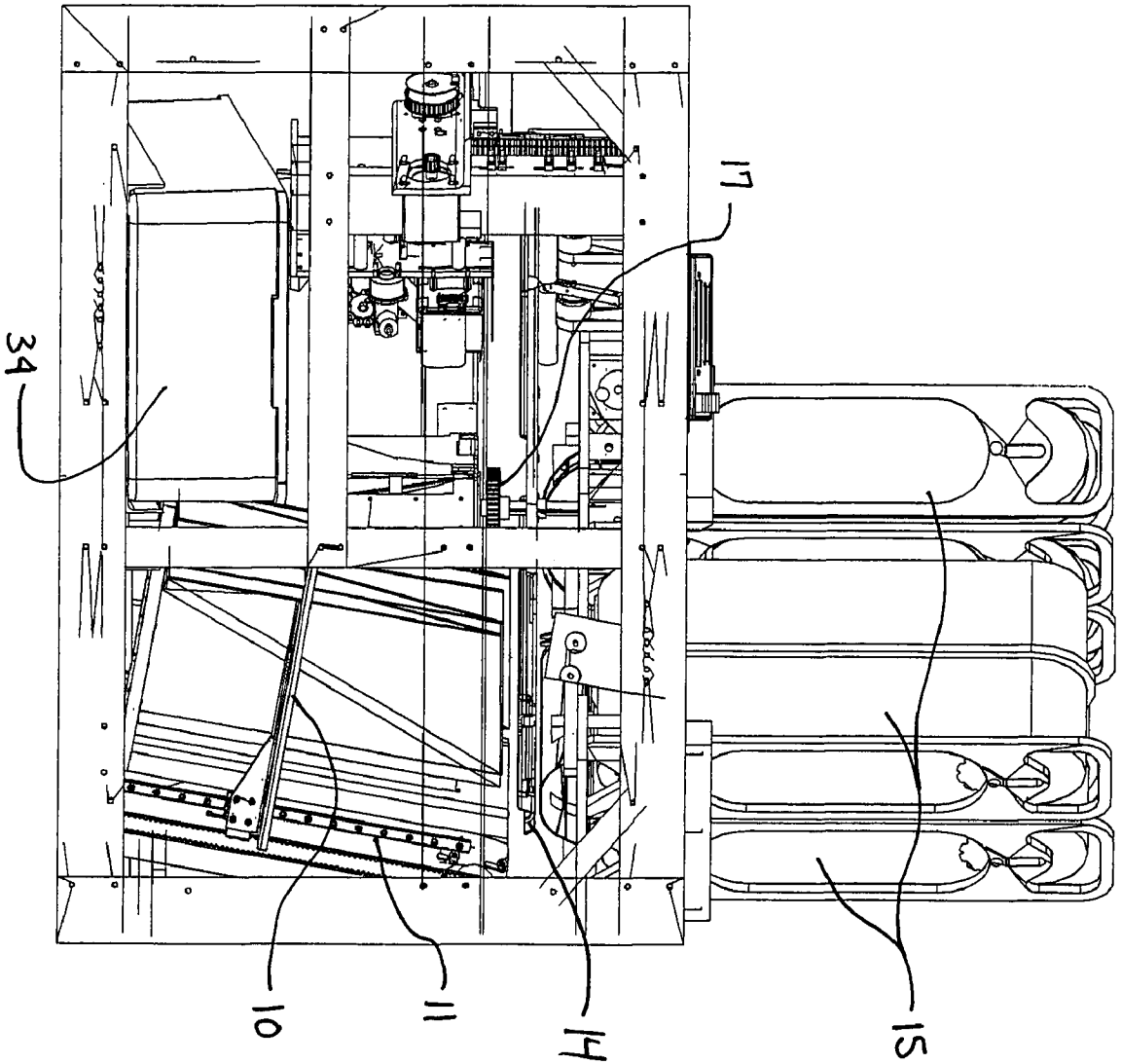
FIG. 1 is a diagram of a front view of an embodiment of the present invention.

Embodiments of the present invention provide for an apparatus and methods for automatic wrapping of items. The present apparatus and method may wrap any type of item in any type of wrapping material. The present invention is particularly useful when used to automatically wrap eating utensils, as further explained below.

The automatic wrapping apparatus may be used for wrapping eating utensils or other items in paper or cloth napkins. There may be an optional band or other securing item used for securing the wrap closed. The apparatus is not intended to be limited to wrapping of utensils in napkins. It may be used for wrapping any item such as other instruments or components besides utensils. Any type of wrapping material may be used such as plastic instead of napkins. The apparatus may be programmed to wrap different amounts and combinations of items. The band used to hold the wrap closed may be a self-adhesive band with a logo. A UV light may be added to the invention for sterilization of utensils or instruments before they are wrapped. This apparatus avoids handling of the eating utensils or other components used after they have been cleaned and sterilized and therefore eliminates the possibility of contamination by human hands. The dirty utensils are loaded into the cassettes which may be put into a dishwasher, then directly onto the apparatus for wrapping. Thus eliminating any handling of the utensils after cleaning. After they are wrapped securely the utensil or component wrap is then provided to the customer. The method and apparatus shown here provides a cost savings to the manual operation presently performed. It also provides a cleaner and more hygienic way of wrapping utensils in napkins which is the preferred way of presenting utensils to the customer in an environment such as a restaurant.

Cassettes may be used to hold the items to be wrapped. A plurality of cassettes may be used, each holding a different type of item. A rotating table may be used in conjunction with the cassettes, where a napkin is drawn onto the table in a first location below one of the cassettes. A utensil is then deposited from the cassette onto the napkin on the table. Alternatively two cassettes may be positioned side-by-side so that they can each deposit a utensil on the napkin, and they may deposit different types of utensils. The table may then be rotated so that the napkin with the utensil(s) deposited thereon is rotated to be under a second cassette (or pair of cassettes). At the same time, another napkin is drawn onto the table and positioned beneath the first cassette (or pair of cassettes). The second cassette (or pair of cassettes) can then deposit a second item (or pair of items) on the napkin. Any number of cassettes or pairs of cassettes may be used in conjunction with the invention. The cassettes can be loaded into dishwashers for cleaning the utensils.

The apparatus may thus include a plurality of depositing positions in which the rotating table may be positioned beneath the cassettes for depositing items onto the wrapping material on the table. The apparatus may also include a wrapping station where the items are wrapped in the wrapping material, and a banding station where a band or other securing item may be placed around the wrapped items. The details of these aspects are further explained below in conjunction with the drawings.

FIG. 1 is a diagram illustrating the wrapping apparatus 8 of the present invention. The wrapping apparatus 8 includes a platform 10, which can hold a stack of wrapping material, which may be napkins. The platform may be raised and lowered by a platform height changing mechanism 11, which may be a motorized, pneumatic or mechanical mechanism. Cassettes 15 have items to be wrapped loaded therein. Rotating table 14 is rotated by a motor 17, pneumatic drive or mechanical indexing method, which may stop at specific programmed locations, as further explained below. Storage bin 34 is used to store the wrapped items.

Figure 2:
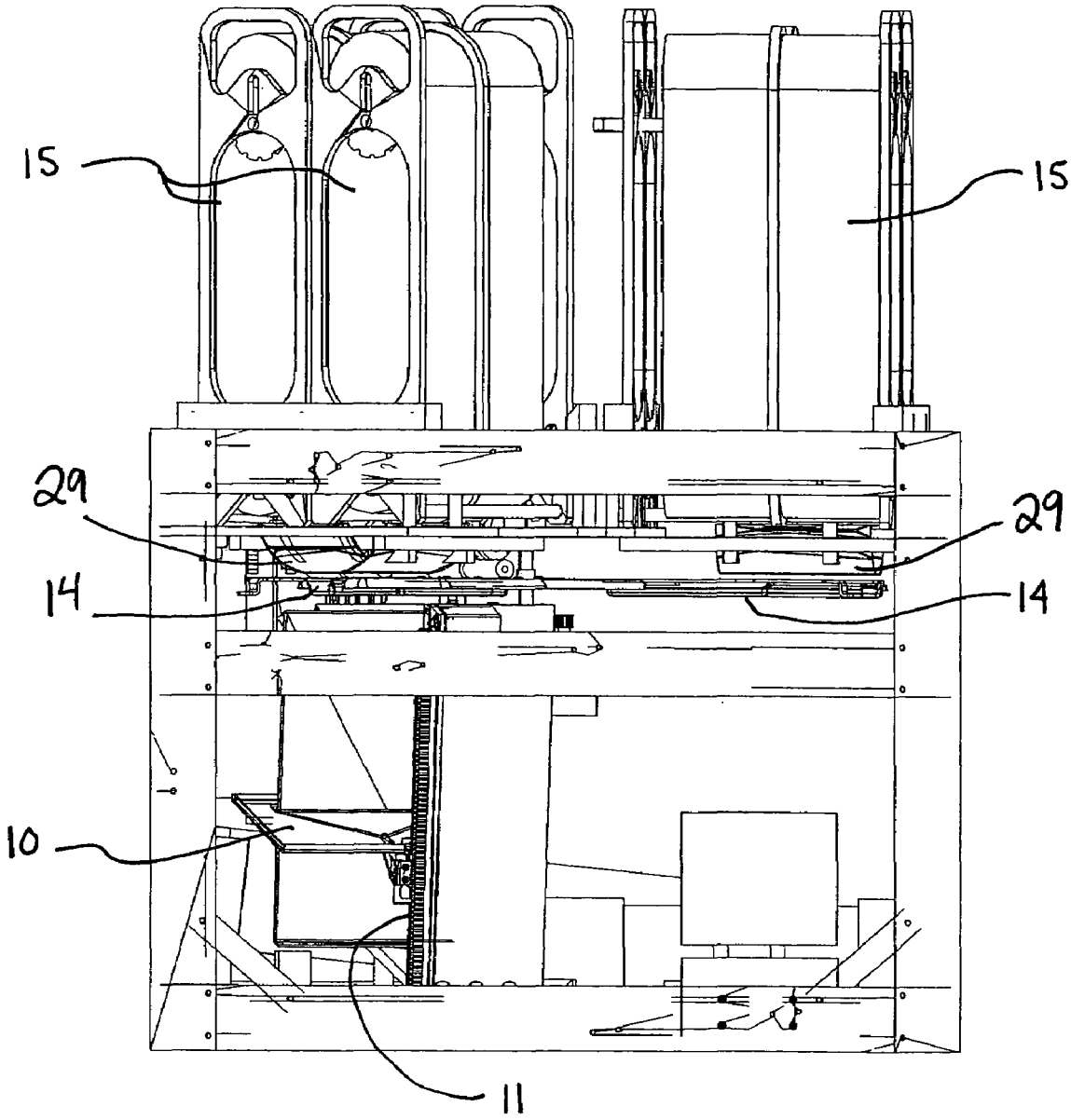
FIG. 2 is a diagram illustrating side view of an embodiment of the present invention.

FIG. 2 shows a side view of the wrapping apparatus 8. Table 14 can be seen to have various portions positioned below the cassettes 15. As will be further explained below, the table is rotated so that the cassettes can deposit items or utensils when the appropriate portion of the table is positioned below the appropriate cassette.

Figure 3:
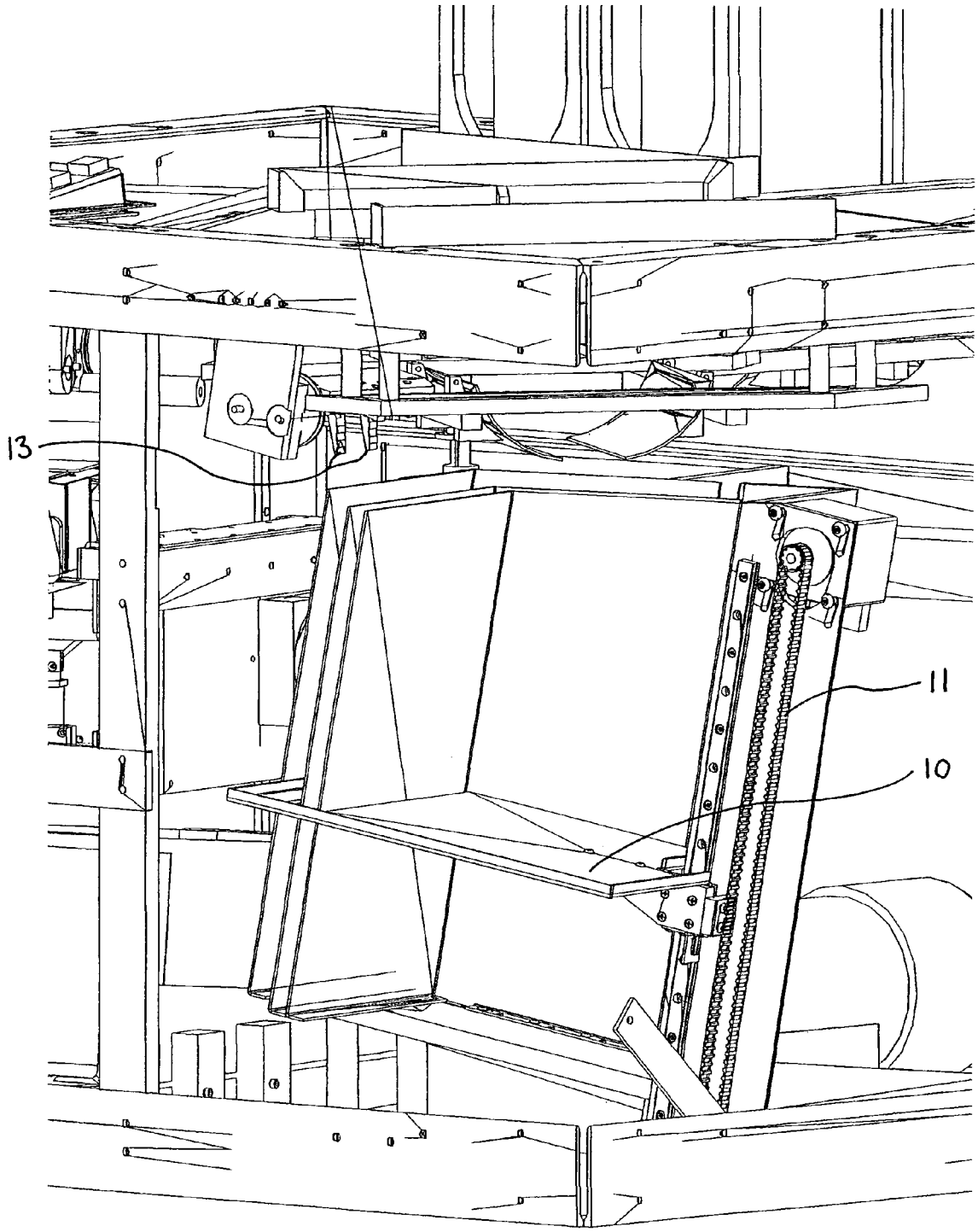
FIG. 3 is a diagram illustrating the platform and associated elements in an embodiment of the present invention.
Figure 4:
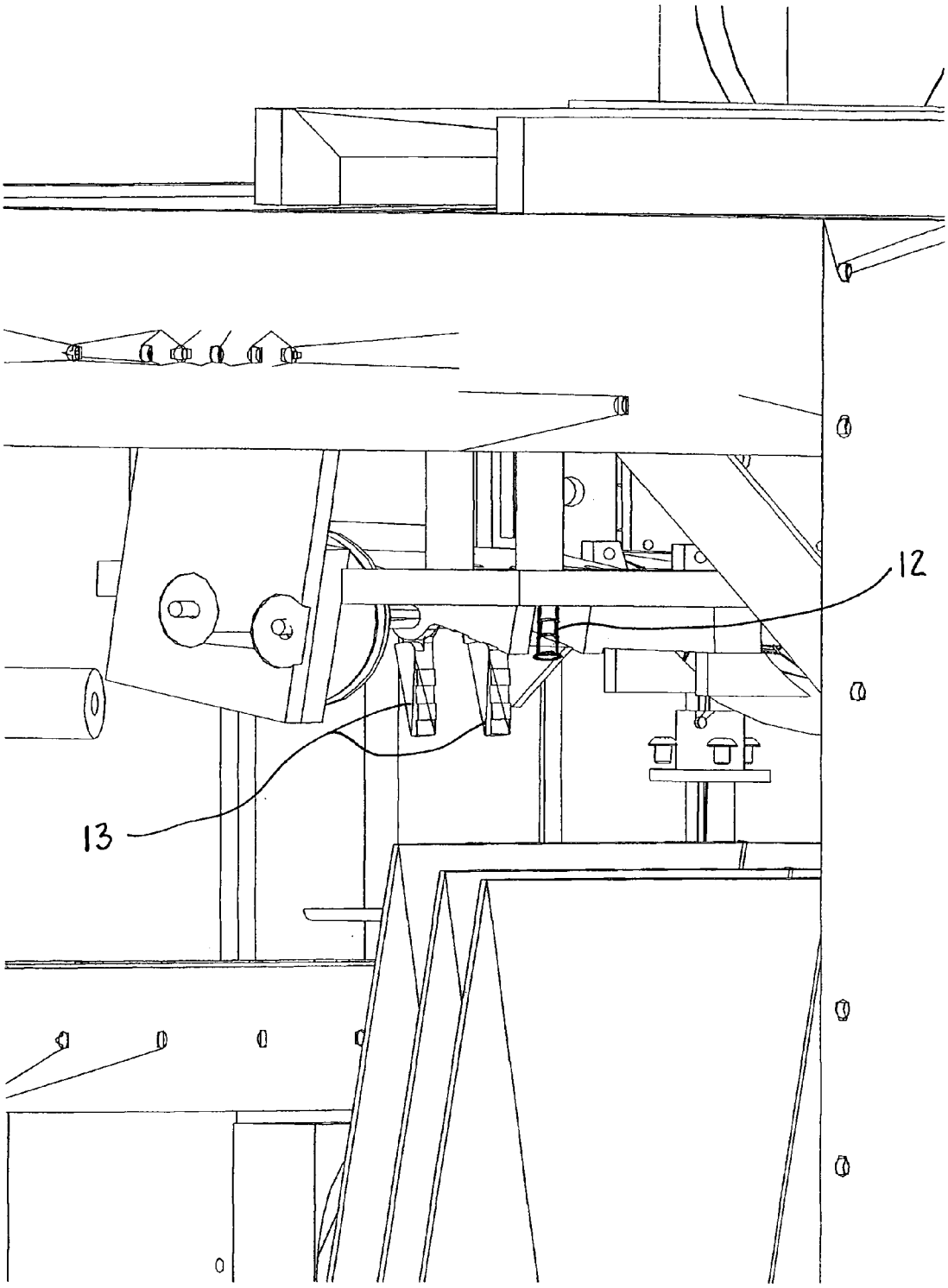
FIG. 4 is a diagram illustrating a vacuum head and clamps in accordance with an embodiment of the present invention.
Figure 5:
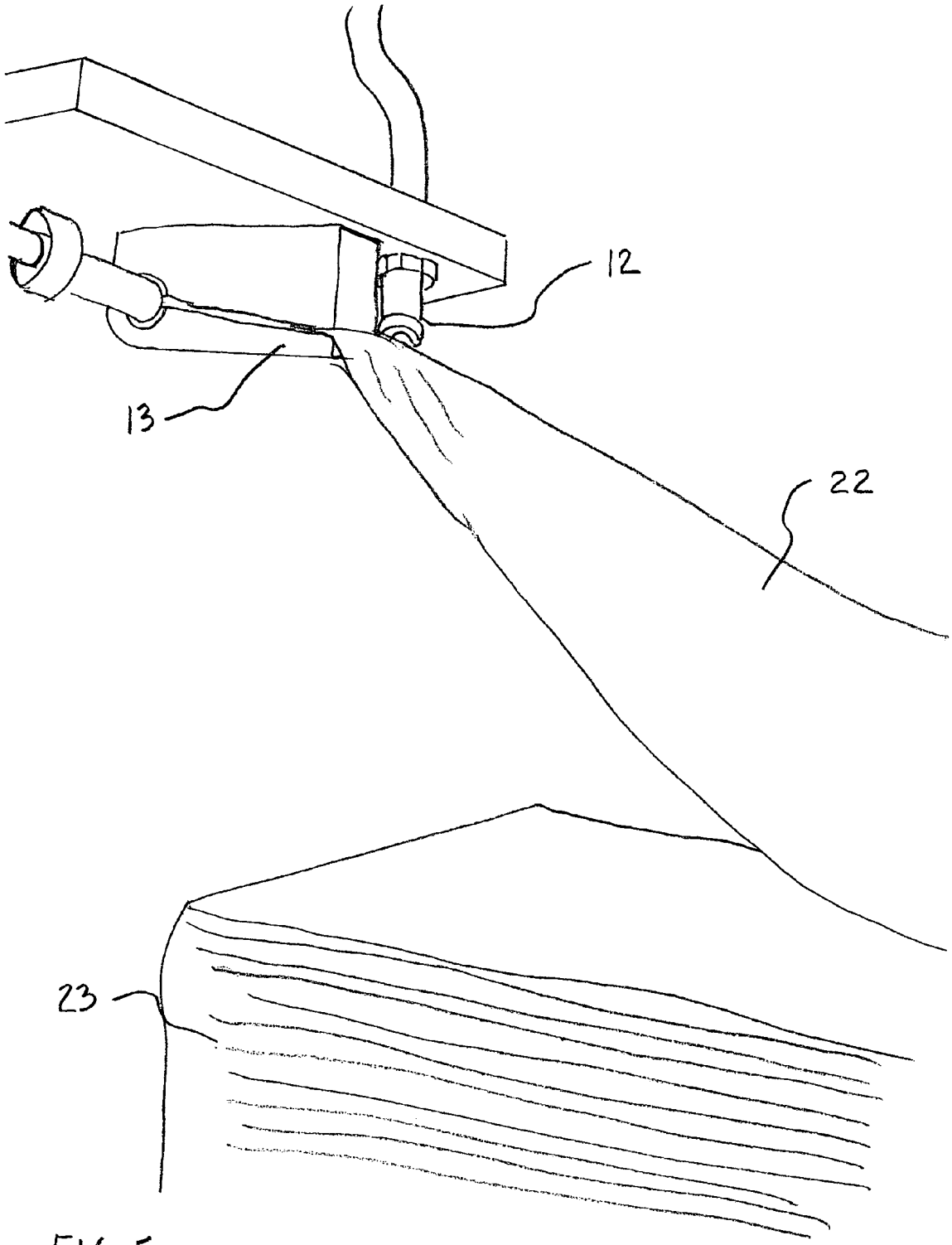
FIG. 5 is a diagram illustrating a napkin being removed from a stack in accordance with an embodiment of the present invention.
Figure 6:
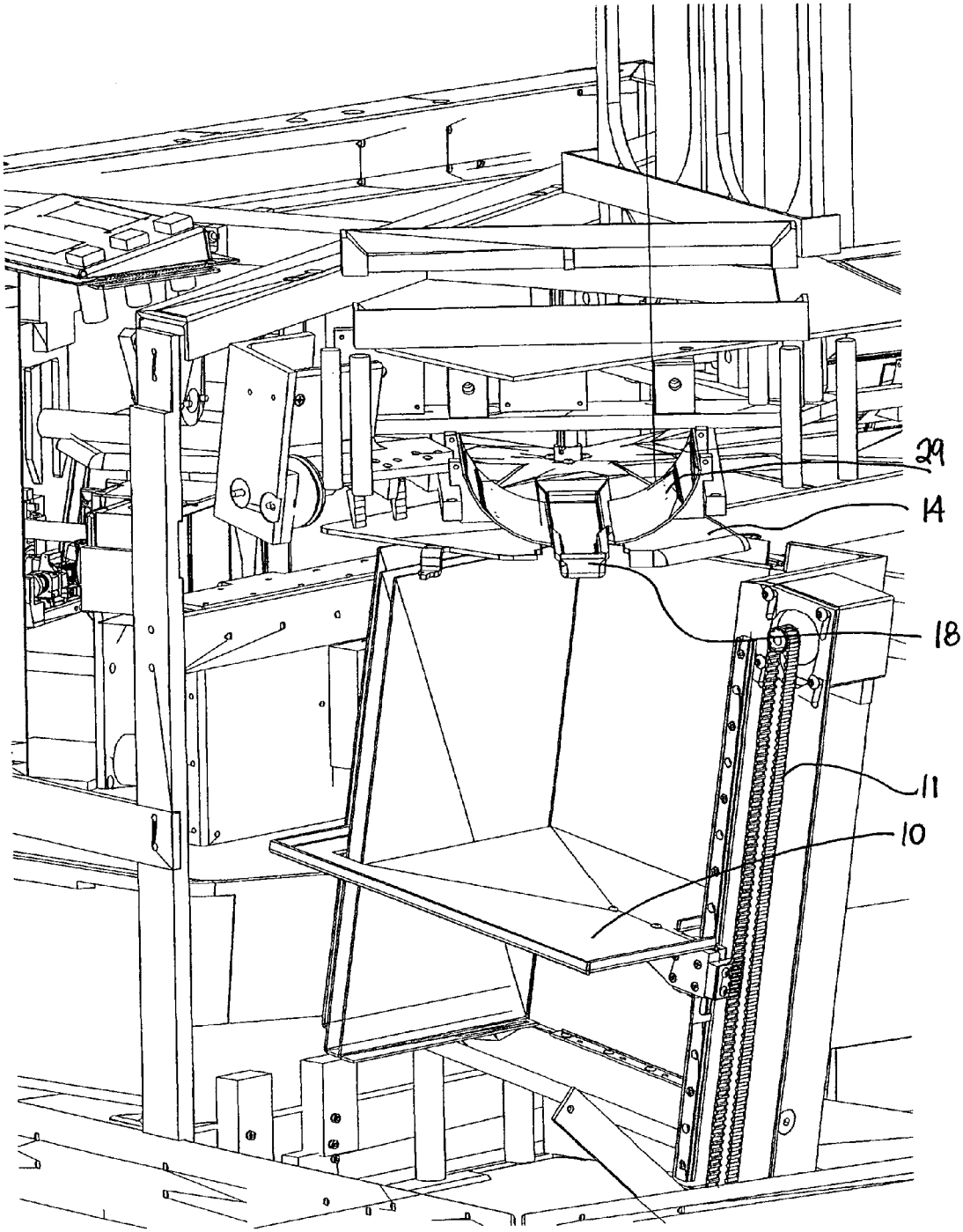
FIG. 6 is a diagram illustrating a platform and associated elements in accordance with an embodiment of the present invention.

FIGS. 3–5 illustrate some of these elements in greater detail. As shown in FIG. 4 and FIG. 5, a vacuum pick up head 12 may be used in association with clamps 13, to remove a napkin 22 from the top of a stack of napkins 23. Other means may be used for removing a napkin from the stack. The stack of napkins is raised until the top napkin contacts the vacuum pick up head 12. The table 14 has cutout portions that allow the stack of napkins 23 to be raised therebetween when the table 14 is appropriately positioned. Conversely, the vacuum head could be lowered to make contact with the top napkin 22 as well. The stack of napkins is then lowered, leaving the top napkin 22 slightly raised above the stack or the vacuum head may be raised. Clamps 13 that are open, close as soon as the platform 10 is lowered slightly and clamp onto the raised napkin 22 to hold it there, waiting for the rotating table 14 to rotate underneath the napkin 22. The motor 17 is engaged to cause table 14 to rotate until a pocket 18, as shown in FIG. 6, is underneath the napkin 22. Then the clamps 13 release the napkin onto the table 14. FIG. 4 illustrates area around the vacuum pick up head 12 and the clamps 13 in greater detail.

FIG. 5 illustrates a napkin 22 being picked up from the stack of napkins 23. The clamps 13 have grabbed the napkin 22 after it was raised on the stack of napkins 23 by the platform height changing mechanism 11. The table 14 is shown in FIG. 5 prior to being rotated to place the napkin on the table 14.

Figure 7:
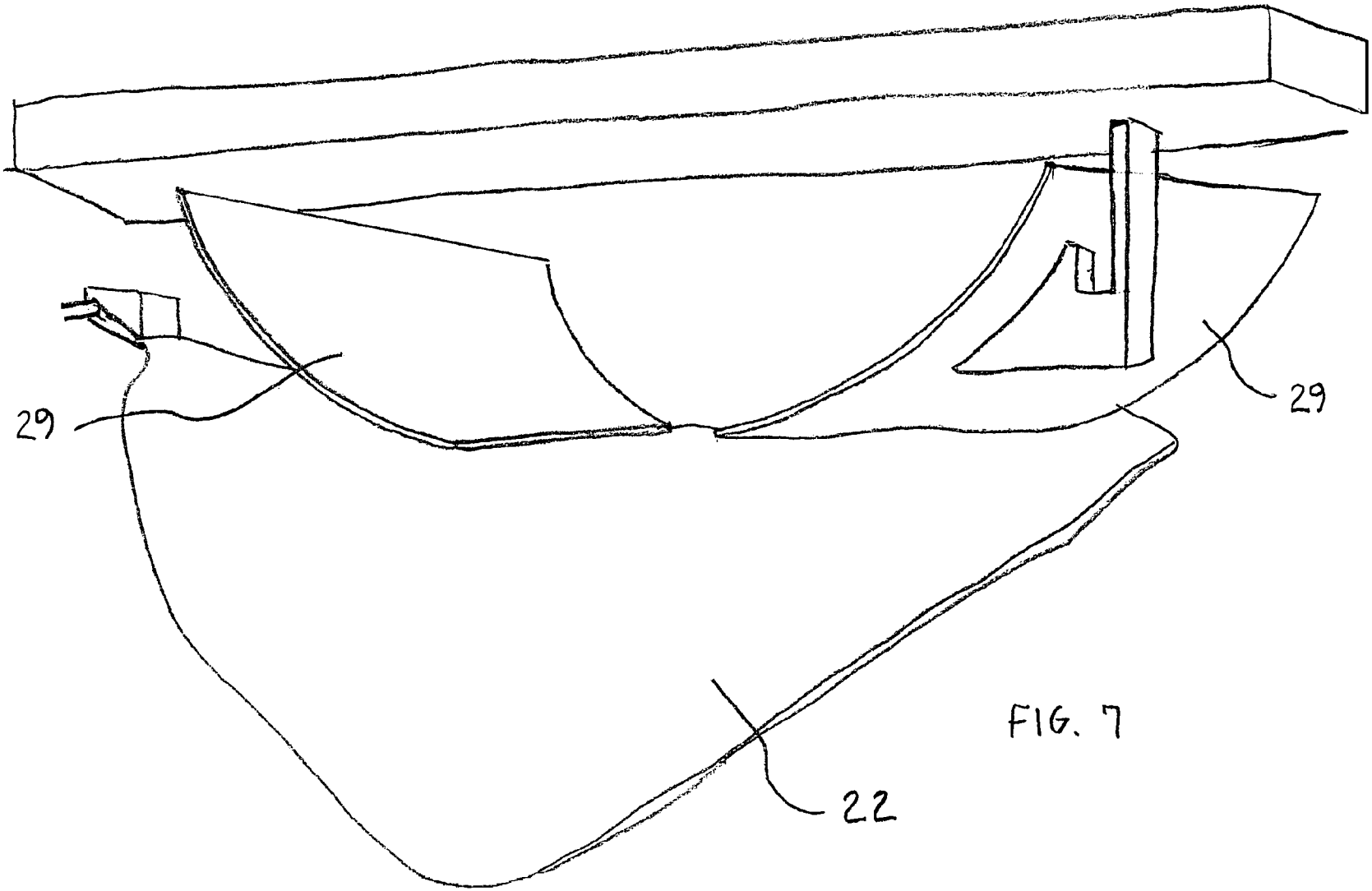
FIG. 7 is a diagram illustrating a napkin on a table in accordance with an embodiment of the present invention.

FIG. 7 illustrates the napkin 22 on the table 14. Ramps 29 are also visible and will be further explained below.

Figure 8:
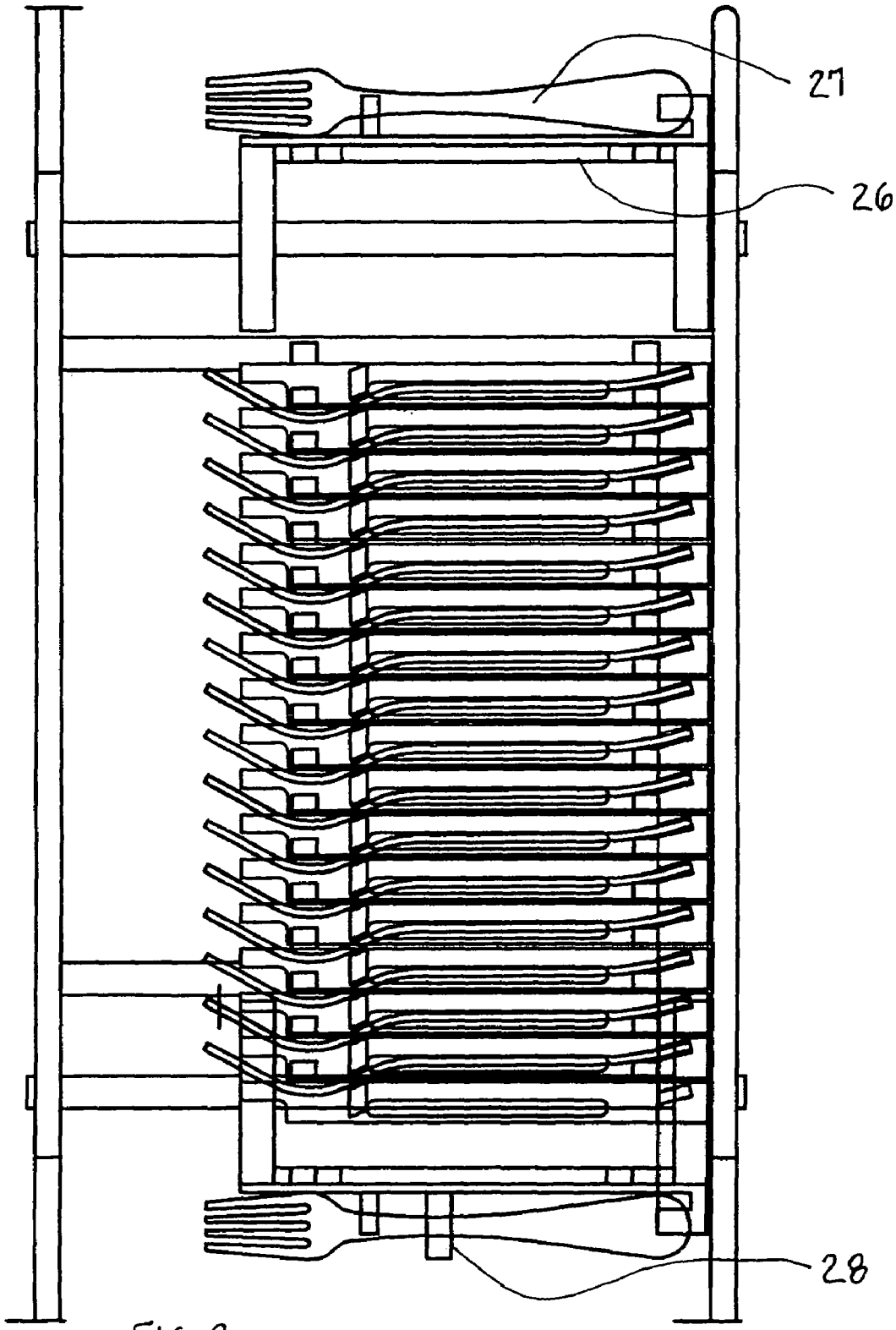
FIG. 8 is a diagram illustrating a cassette and utensils in accordance with an embodiment of the present invention.
Figure 9:
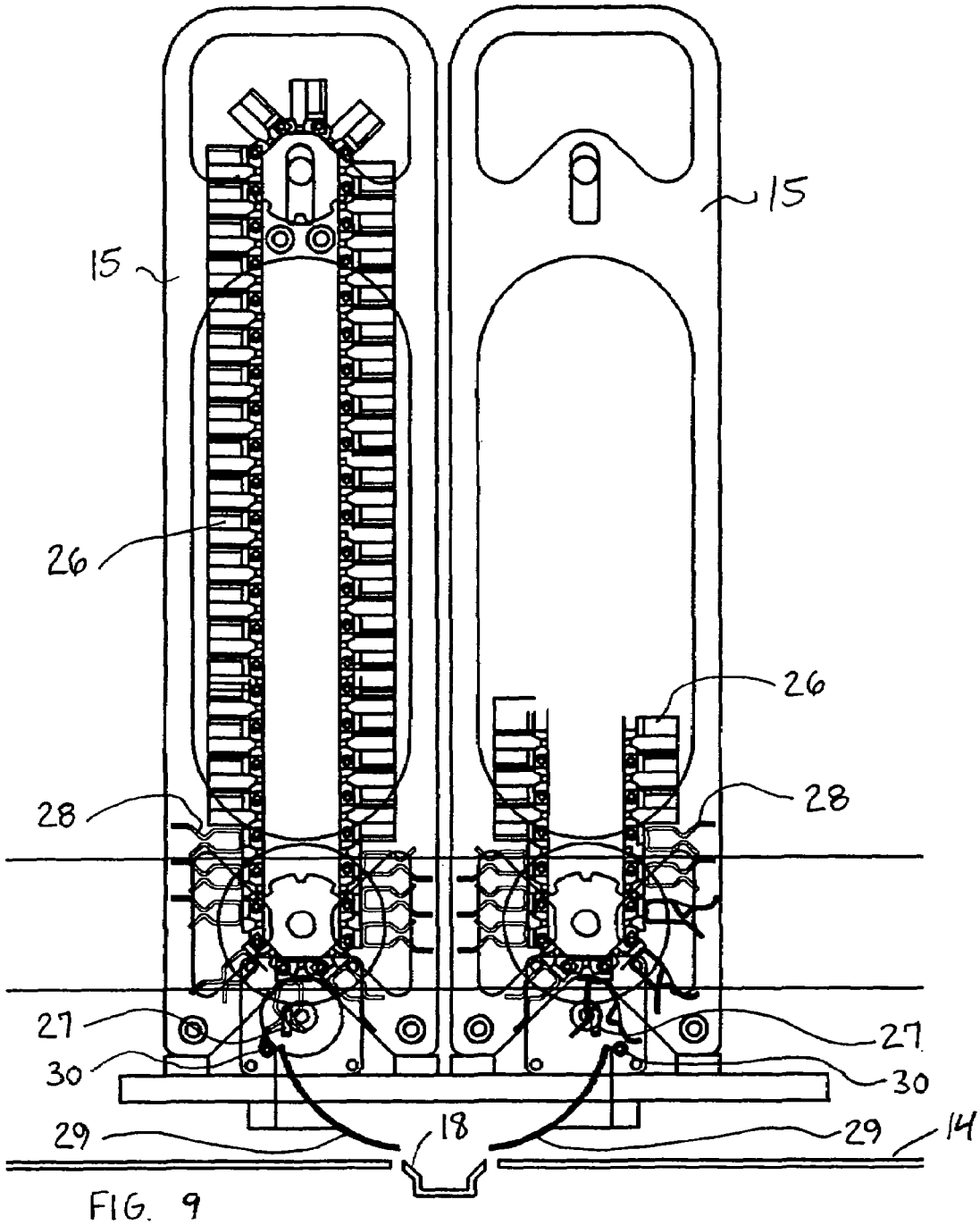
FIG. 9 is a diagram illustrating a pair of cassettes in accordance with an embodiment of the present invention.

FIG. 8 illustrates a cassette 15 with utensils 27 loaded therein. The utensils 27 shown are forks. Other eating utensils may be used as well. As mentioned above, any type of item that need to be wrapped may be used in place of the utensils 27. Once a napkin 22 is located in a first location on the table 14, utensils 27 in the cassette 15 above the located napkin may then be deposited onto the napkin below by rotating the holders 26. The holders 26 are attached to each other and form a belt that may be rotated by a gear and a motor or mechanical means. A clip 28 holding the prescribed utensil 27 opens and releases the utensil 27 onto a ramp 29 when the clip is engaged with the ramp 29 or roller 30 and opens up. As may be seen with reference to FIG. 9, the ramp 29 then deposits the utensil onto the table 14. The table 14 may have a slight indent or pocket 18 in the area where the utensils will lie to nest them and prevent them from sliding around while the table rotates to the next stop. The embodiment of FIG. 9 illustrates two cassettes formed side-by-side.

Referring back to FIG. 2, it may be seen that the table 14 has different portions that can be positioned below each of a plurality of pairs of cassettes 15, although single cassettes in each position could equally as well be used. When the table 14 is appropriately positioned with a napkin thereon, each cassette is controlled to release the appropriate utensils onto ramps 29, which directs the utensils onto the napkins on table 14. The table 14 is rotated from position to position to deposit the desired utensils from each cassette or pair of cassettes onto the napkin on table 14.

Figure 10:
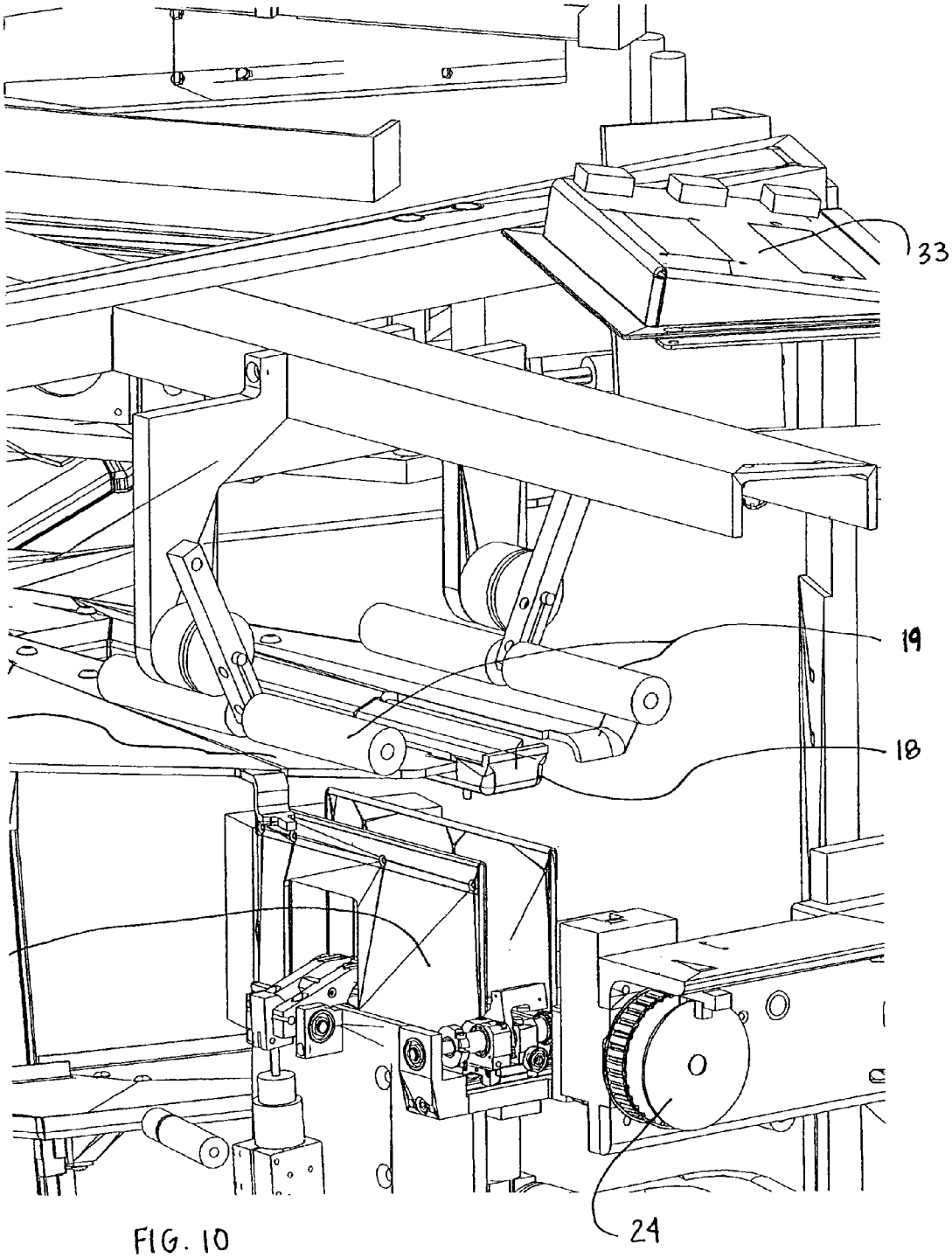
FIG. 10 is a diagram illustrating a wrapping station in accordance with an embodiment of the present invention.
Figure 11:
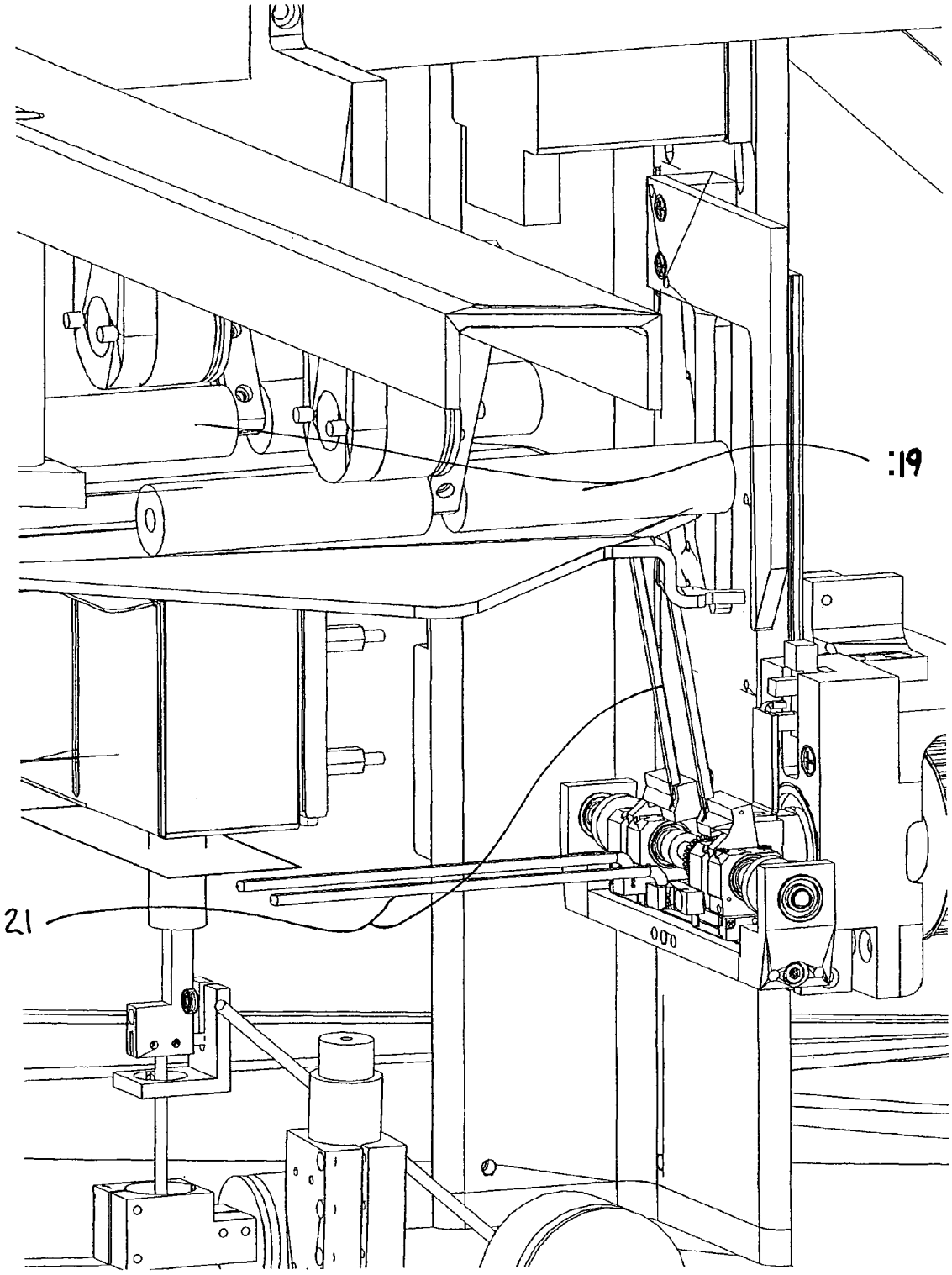
FIG. 11 is a diagram illustrating rods and associated elements in accordance with an embodiment of the present invention.
Figure 12:
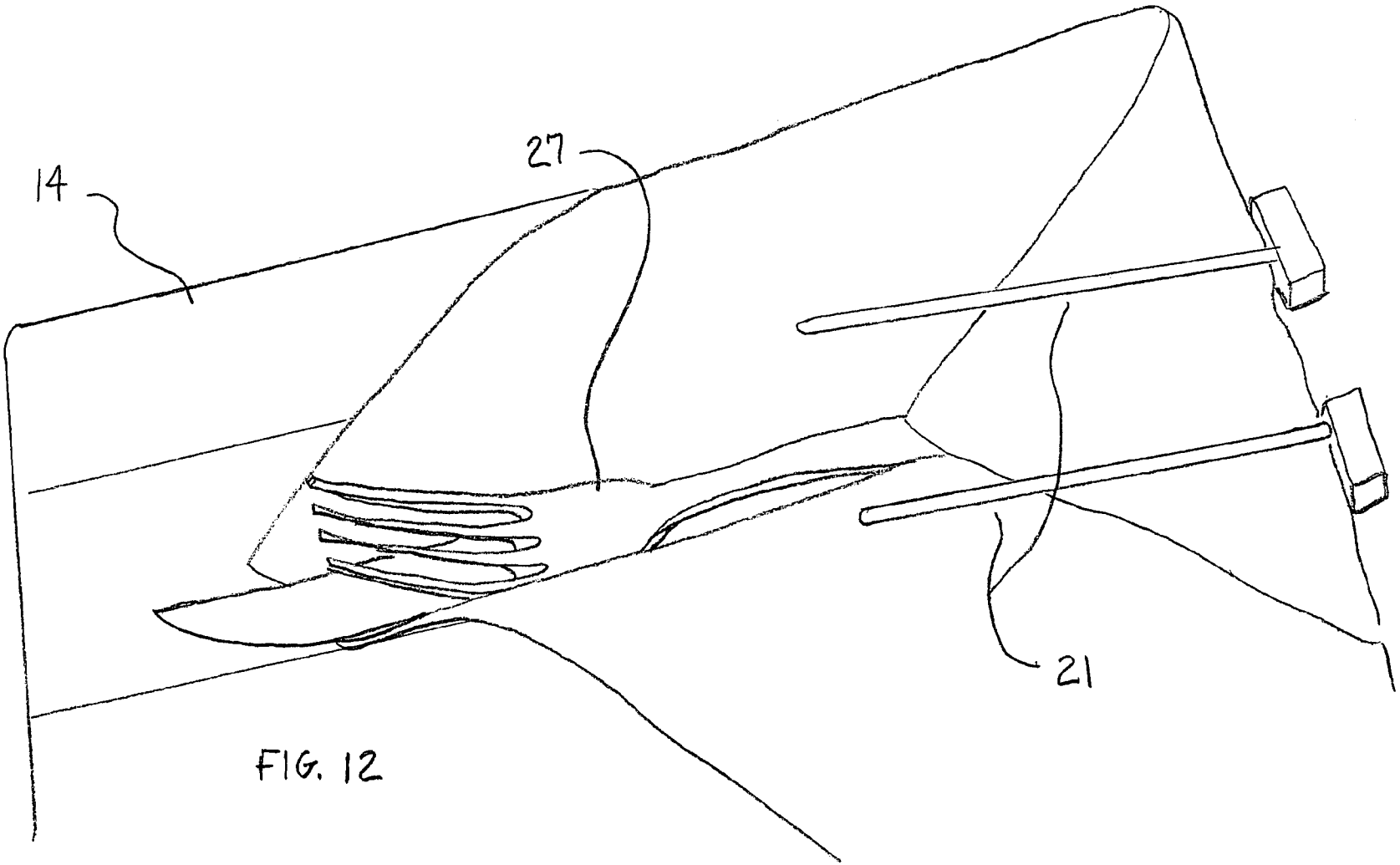
FIG. 12 is a diagram illustrating utensils on a wrap being held by rods in accordance with an embodiment of the present invention.

FIGS. 10–12 illustrate one or more locations around the table 14 designed for folding and wrapping the utensils in the napkin they lie on. At that specific location, rollers 19 may spread and hold the napkin at the fold line and 2 sets of pincher rods 21 may fold the corner of the napkin over the utensils that have been deposited onto that napkin by being driven closed upon themselves by a motor, spring or mechanical means. The pincher rods 21 may accomplish this by pivoting one rod towards the other until they are parallel with each other and squeezing the napkin fold between them. The pincher rods may then lift the napkin with the utensils up off the table by a motor or mechanical means and the 2 sets of pinchers rods are then driven closer together by a guide and springs. The table 14 then rotates to another location and that allows the folder to be driven below the table by a motor or mechanical means with the napkin and utensils to a wrapping station 35 and/or banding station or may be rotated to a banding station 16 after wrapping by a motor, pneumatic drive or mechanical means 24.

Figure 13:
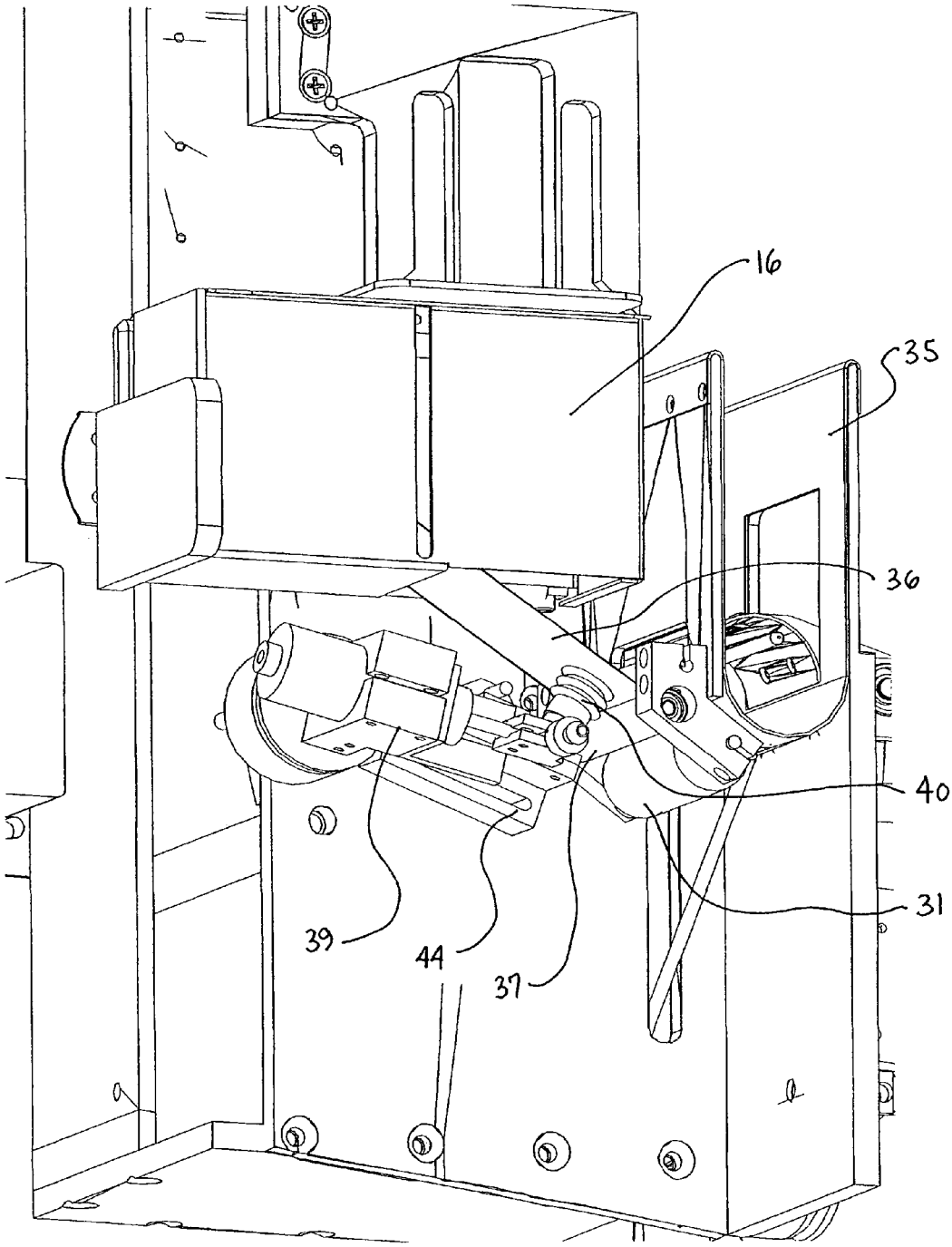
FIG. 13 is a diagram illustrating a banding station in accordance with an embodiment of the present invention.
Figure 14:
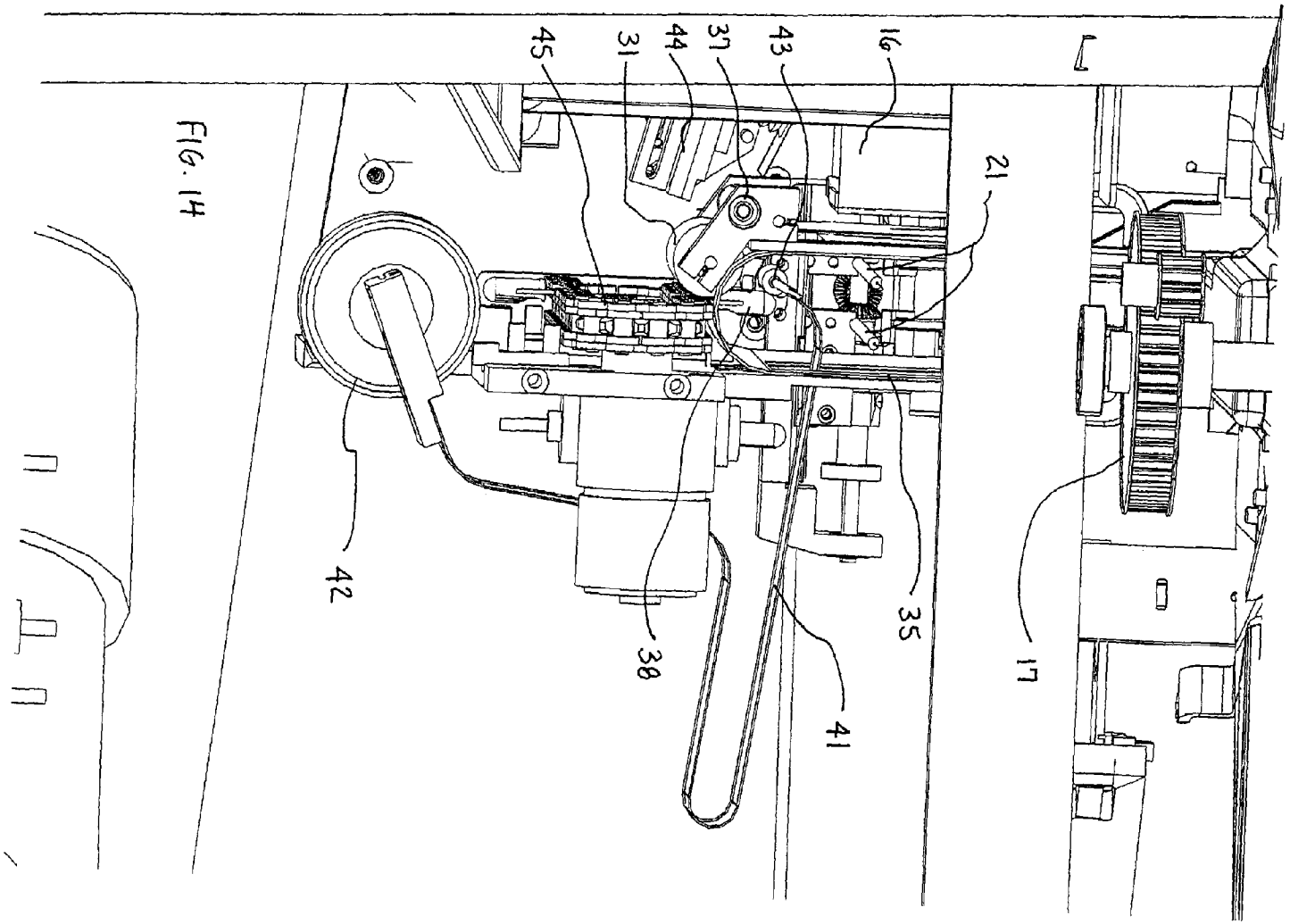
FIG. 14 is a diagram illustrating elements associated with banding in accordance with an embodiment of the present invention.

FIGS. 13 and 14 illustrate an optional banding station 16 and associated elements that may be used to put a band, which may be self-adhesive with a logo, onto the napkin as it is rotated after it is wrapped. This band will hold the wrap or napkin closed. The pincher rods 21 holding the napkin and utensils, move to a position below the table 14. The banding station 16 is located next to the wrapping station. The pincher rods may be rotated against the sides of the wrapping station to wrap the utensils in the napkin. Once wrapped, a vacuum head 40 will be extended or rotated towards the bottom of the band stack by mechanical element 39 to make contact with a band. Vacuum will then be made with the band and rotating or retracting the vacuum head 40 will pull a band 36 out of a cartridge of bands. The vacuum will then be released and the band 36 will then be presented to the wrap by means of rollers 37 that are driven by a motor. The band 36 may be inserted into the banding station a certain amount by means of time or a sensor 44 that shuts the motors off. The wrap may then be lowered onto the band 36. A lid 41 is closed by a mechanical element 42 over the wrap to encase the band 36 around the wrap. A roller 31, which is activated by the presence of the wrap on the roller, may press the band 36 against the wrap to seal it on itself as the wrap is rotated with the band 36 around it. This ensures that the band 36 follows the wrap as it is rotated against the sides of the wrapping station 16. As the wrap is rotated the rest of the band 36 is fed into the banding station by the rollers and the top edge of the band 36 is curled underneath by the lid 41 so the band 36 is sealed upon itself. The lid 41 may have a roller 43 at the end of it or several rollers to help the band 36 curl upon itself and wrap the band tight.

After the utensils are wrapped and banded, the pincher rods 21 release the tension between them to allow a pin 38 to be rotated or moved by mechanical means 45 between the rods 21 and push the wrap onto a conveyor or slide located above a storage bin 34 and below the rods 21. The conveyor or slide carries the wrap slowly down to the storage bin and deposits it into the bin. The conveyor or slide indexes backwards and forwards to allow even distribution of wraps into the bin. The storage bin may be located in such a position as to allow removal of the bin 34 with complete napkin wraps. If the storage bin 34 is not used, the design may have a slide, which slides the completed napkin wraps onto a table.

Figure 15:
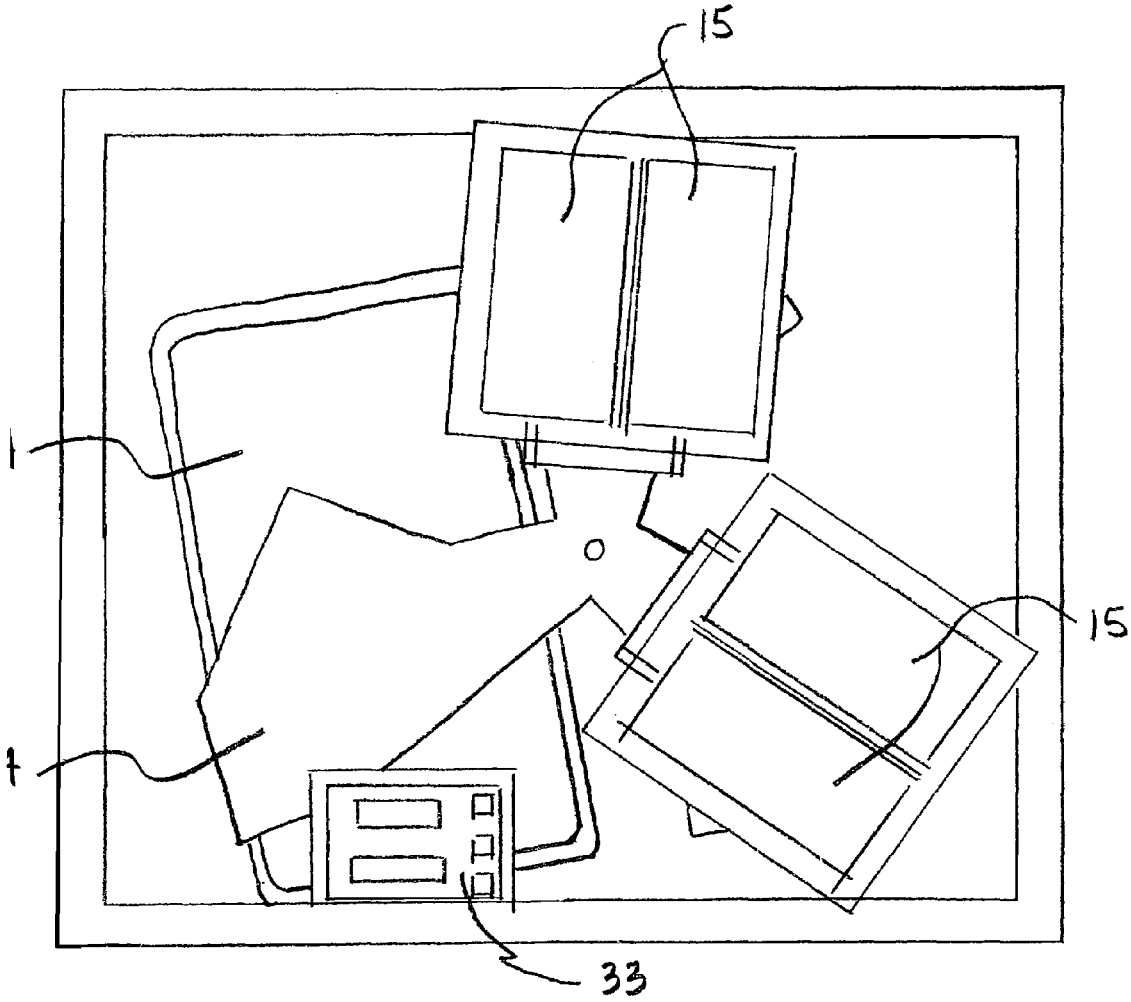
FIG. 15 is a diagram illustrating a top view of the wrapping apparatus in accordance with an embodiment of the present invention.

FIG. 15 illustrates a top view of the wrapping apparatus. Two pairs of cassettes 15 holding utensils are shown, along with storage bin 34 and rotating table 14. Also illustrated is electronic interface 33, which may be a programmable device. Electronic interface 33 will typically include some setting for controlling the wrapping apparatus to deposit the appropriate number and type of utensils on each wrap. It may also include settings allowing a user to set whether or not a band is to be put on each wrap. The electronic interface may include a touch screen or other type of interface allowing easy programming by a user.

Several embodiments of the invention are specifically illustrated and/or described herein. However, it will be appreciated that modifications and variations of the invention are covered by the above teachings and within the purview of the appended claims without departing from the spirit and intended scope of the invention.

What is claimed is:

1. A wrapping apparatus, comprising:

a first holder for holding first items to be wrapped;

a rotating table;

means for placing wrapping material on the rotating table when the rotating table is rotated into a first position;

means for moving one of the first items to be wrapped from the first holder onto the wrapping material on the rotating table;

a second holder for holding second items to be wrapped;

means for moving one of the second items to be wrapped from the second holder onto the wrapping material on the rotating table when the rotating table is rotated to a second position; and a wrapping mechanism for wrapping the first item and second item in the wrapping material.

2. The wrapping apparatus of claim 1, wherein the wrapping mechanism comprises a wrapping station disposed adjacent to a third position of the rotating table.

3. The wrapping apparatus of claim 1, wherein the first holder comprises a rotary cassette that holds the plurality of first items, and ejects one of the first items upon receipt of a corresponding signal.

4. The wrapping apparatus of claim 3, wherein the cassette includes holders forming a rotary belt.

5. The wrapping apparatus of claim 4, wherein each holder in the cassette includes a clip for gripping one of the items.

6. The wrapping apparatus of claim 1, further comprising an electronic interface that allows a user to control whether the first and second holders will release first and second items.

7. The wrapping apparatus of claim 1, further comprising a banding station that applies a band to the wrapped first item and second item.

8. The wrapping apparatus of claim 7, further comprising a lid and rollers for applying the band to the wrapping material.

9. The wrapping apparatus of claim 1, wherein the means for placing a wrapping material on the rotating table comprises an elevator platform for raising the wrapping material to a desired position, and means for removing the wrapping material from the elevator platform.

10. The wrapping apparatus of claim 1, wherein the first items to be wrapped are eating utensils.

11. The wrapping apparatus of claim 1, wherein the wrapping material is a napkin.

12. The wrapping apparatus of claim 1, further comprising pincher rods for folding a corner of the wrapping material over the first item and second item to be wrapped, and for lifting and rotating the wrapping material and first item and second item to be wrapped.

13. A method for wrapping items in a wrapping material, comprising:

holding first items to be wrapped in a holder;

placing the wrapping material on a rotating table when the rotating table is rotated into a first position;

moving one of the first items to be wrapped from the first holder onto the wrapping material on the rotating table;

holding second items to be wrapped in a second holder;

moving one of the second items to be wrapped from the second holder onto the wrapping material on the rotating table when the rotating table is rotated to a second position; and wrapping the first item and second item in the wrapping material with a wrapping mechanism.

14. The method of claim 13, wherein the wrapping mechanism comprises a wrapping station disposed adjacent to a third position of the rotating table.

15. The method of claim 13, wherein the first holder comprises a rotary cassette that holds the plurality of first items with holders, further comprising ejecting one of the first items upon receipt of a corresponding signal.

16. The method of claim 15, wherein the cassette includes holders forming a rotary belt.

17. The method of claim 16, wherein each holder in the cassette includes a clip for gripping one of the items.

18. The method of claim 13, further comprising allowing a user to control whether the first and second holders will release first and second items with an electronic interface.

19. The method of claim 13, further comprising applying a band to the wrapped first item and second item at a banding station.

20. The method of claim 19, further comprising applying the band to the wrapping material using a lid having rollers.

21. The method of claim 13, wherein placing the wrapping material on the rotating table comprises raising the wrapping material to a desired position with an elevator platform, and removing the wrapping material from the elevator platform.

22. The method of claim 13, wherein the first items to be wrapped are eating utensils.

23. The method of claim 13, wherein the wrapping material is a napkin.

24. The method of claim 13, further comprising pincher rods for folding a corner of the wrapping material over the first item and second item to be wrapped, and for lifting and rotating the wrapping material and first item and second item to be wrapped.

* * * * *